United States Patent [19]

Tholen

[11] 4,442,803

[45] Apr. 17, 1984

[54] LIGHT METAL CYLINDER HEAD FOR INTERNAL COMBUSTION ENGINES

[75] Inventor: Paul Tholen, Bergisch Gladbach, Fed. Rep. of Germany

[73] Assignee: Klöckner-Humboldt-Deutz Aktiengesellschaft, Cologne, Fed. Rep. of Germany

[21] Appl. No.: 468,898

[22] Filed: Feb. 23, 1983

Related U.S. Application Data

[62] Division of Ser. No. 187,519, Sep. 15, 1980, Pat. No. 4,387,678.

[30] Foreign Application Priority Data

Sep. 19, 1979 [DE] Fed. Rep. of Germany ..... 2937788

[51] Int. Cl.[3] ..... F02F 1/26

[52] U.S. Cl. ..... 123/41.69; 123/193 CH

[58] Field of Search ..... 123/193 R, 193 H, 193 CH, 123/41.69

[56] References Cited

U.S. PATENT DOCUMENTS 1,371,732 3/1921 Bradshaw ..... 123/41.69

FOREIGN PATENT DOCUMENTS 877382 5/1953 Fed. Rep. of Germany ..... 123/193 CH

*Primary Examiner*—Craig R. Feinberg

*Attorney, Agent, or Firm*—Becker & Becker, Inc.

[57] ABSTRACT

A light metal cylinder head for internal combustion engines, with a metal plate arranged on the cylinder head bottom. The plate has an annular insert on its outer periphery. The annular insert is arranged on the cylinder head and/or cylinder pipe in such a manner that forces are effective upon the metal plate due to different heat stresses occurring in operation, so that the plate engages against the cylinder head bottom.

1 Claim, 5 Drawing Figures

LIGHT METAL CYLINDER HEAD FOR INTERNAL COMBUSTION ENGINES

This is a Divisional Application based upon co-pending parent application Ser. No. 187,519-Tholen filed Sept. 15, 1980, now U.S. Pat. No. 4,387,678-Tholen dated June 14, 1983.

The present invention relates to a light metal cylinder head for internal combustion engines, according to which a metal plate is arranged on the cylinder head bottom; along its outer circumference, the plate has a ring-shaped or annular insert.

Such metal plates are known. As a rule, the plates are made of gray cast iron, and are used with air-cooled self-ignition internal combustion engines, mainly with such engines having two-stage combustion, but they are also used with supercharged internal combustion engines in order to prevent the direct influence of the combustion gases upon the cylinder head bottom and thus to protect the light metal cylinder head against too high temperatures.

Such a cylinder head with a metal plate is described in German Pat. No. 525,696. In this disclosure the cylinder head is fastened to the metal plate by means of a screw connection. A part of the outer circumference of the cylinder pipe barrel is provided with a thread, and the cylinder pipe is screwed to the annular insert by means of a thread provided on the inner side of the insert.

The disadvantage of such a connection consists therein that upon heating, the cylinder head and the metal plate expand to a different degree in the radial direction, so that the screw connection between the metal plate and the cylinder pipe is subjected to shear action which can lead to screw breakage. Since the light metal cylinder head expands more strongly during heating than does the metal plate, the heat transfer between the metal plate and the cylinder head is not clearly defined. Consequently, the plate can become too hot and can deform, thus becoming unusable.

The object of the present invention is to arrange the metal plate in the cylinder head in such a way that, in spite of different materials, no leakiness can arise, and a defined heat transfer is obtained between the cylinder head and the metal plate.

This object, and other objects and advantages of the present invention, will appear more clearly from the following specification in connection with the accompanying drawings, in which.

Figure 1:
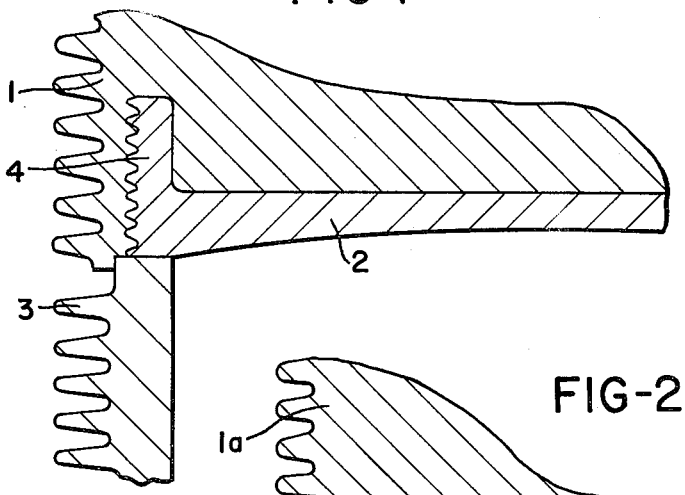
FIG. 1 is a schematic cross sectional view of a portion of the inventive connection location between a cylinder head, metal plate, and cylinder pipe or barrel.

The light metal cylinder head of the present invention is characterized primarily in that the annular insert is arranged on the cylinder head and/or on the cylinder pipe or barrel in such a manner that, due to the different heat stresses arising during operation, forces are effective upon the metal plate in such a way that the metal plate engages against the cylinder head bottom. Hereby the advantage is attained that upon heating of the metal plate and of the cylinder head, as well as of the cylinder pipe, a force is effective upon the metal plate. Thus, the metal plate also engages against the cylinder head bottom with its entire surface during operation, so that a definite and uniform heat transfer is assured between the metal plate and the cylinder head bottom. Accordingly, localized overheating of the metal plate cannot occur, so that a distortion of the metal plate is definitely prevented.

The annular insert can be made of the same material as the metal plate, and can be formed in a unitary embodiment therewith. It is also possible, however, that the annular insert be embodied as a sleeve, on the inside of which an offset portion or shoulder is provided for receiving the metal plate; in this case, the annular insert is produced as a separate cylinder which on its inner mantle surface has an offset portion or shoulder upon which the metal plate engages and by means of which the metal plate is pressed against the cylinder head bottom. In this connection, it is expedient to provide a radial spacing between the metal plate and the annular insert.

Cooling ribs are provided expediently on those outer surfaces of the annular insert facing the surrounding air so that the annular insert remains as cool as possible, since it serves as a support for the metal plate which distorts under heat stress.

The following disclosure sets forth possibilities for fastening the metal plate with simple means on the cylinder head in such a way that forces due to the thermal stresses act upon the metal plate so that it engages more tightly against the cylinder head bottom.

Referring now to the drawings in detail, the figures thereof illustrate the schematically represented cylinder head 1, the metal plate 2, the cylinder pipe or barrel 3, and the annular insert 4.

As shown in FIG. 1, the annular insert 4 and the metal plate 2 form a unit. The annular insert 4 is connected with the metal plate 2 in such a manner that a dish or pan shape results. For improving the heat transfer, on the outer circumference of the annular insert 4, there are provided either a thread or short ribs, by means of which the metal plate 2 and the annular insert 4 are either screwed into the cylinder head 1 or are cast thereinto. In this way, the annular insert 4 is so anchored in the cylinder head 1 that its free end face simultaneously forms a part of the sealing surface with the cylinder pipe 3.

During the heating of the metal plate 2 as well as of the cylinder head 1, the two parts expand radially outwardly. Since the cylinder head 1 is made of light metal, it has a higher expansion coefficient than does the metal plate 2. Consequently, the expanding cylinder head 1 acts on the annular shaped insert 4, so that by way of the annular insert 4 forces are introduced into the metal plate 2 which press the metal plate 2 against the cylinder head bottom. This effect can also be aided thereby that the side of the metal plate facing the combustion chamber is concavely curved. Since the radial expansion of the cylinder head 1 is dependent upon the heating thereof, with increasing heating, a force growing in strength will press the metal plate 2 more and more strongly against the cylinder head bottom, so that a defined heat transfer is made possible between the cylinder head bottom and the metal plate in all possible temperature ranges.

Figure 2:
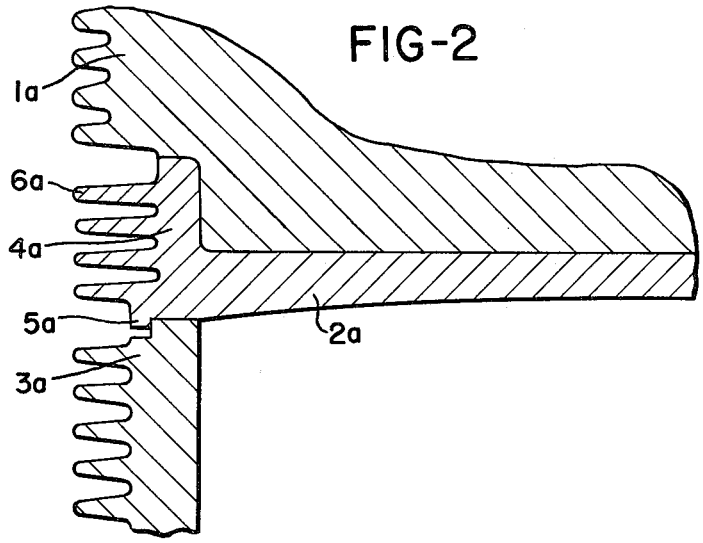
FIG. 2 is a view similar to that of FIG. 1, and shows another embodiment of the present invention.

In FIG. 2, the annular insert 4*a* is likewise embodied in one piece or unitary with the metal plate 2*a*. In contrast to the arrangment according to FIG. 1, the annular insert of the metal plate 2*a* is, so to speak, embodied as a cover which radially surrounds the cylinder head bottom. In contrast to the embodiment of FIG. 1, in the embodiment of FIG. 2, there is provided an annular collar, shoulder, or flange 5*a* on that end face of the annular insert 4*a* facing the cylinder pipe 3*a*, and this flange surrounds the cylinder pipe 3*a* on its outer circumference. Since the annular insert 4*a* now has an outer side facing the surrounding air, it is advantageous to provide this side with cooling ribs or vanes 6*a*. Consequently, the lower temperature level of the annular insert 4*a* is further reinforced relative to the metal plate 2*a*. Consequently, the insert 4*a* forms a practically rigid abutment surface for the cylinder head 1*a* which expands when subjected to heat. Also here, as in the embodiment of FIG. 1, the expanding cylinder head 1*a* exerts a force against the annular insert 4*a* in such a manner that the metal plate 2*a*, depending upon the force, is pressed more or less strongly against the cylinder head bottom. That side of the metal plate 2*a* facing the combustion chamber can likewise be concavely curved, so that the pressing thereof against the cylinder head bottom during heating is enhanced.

Figure 3:
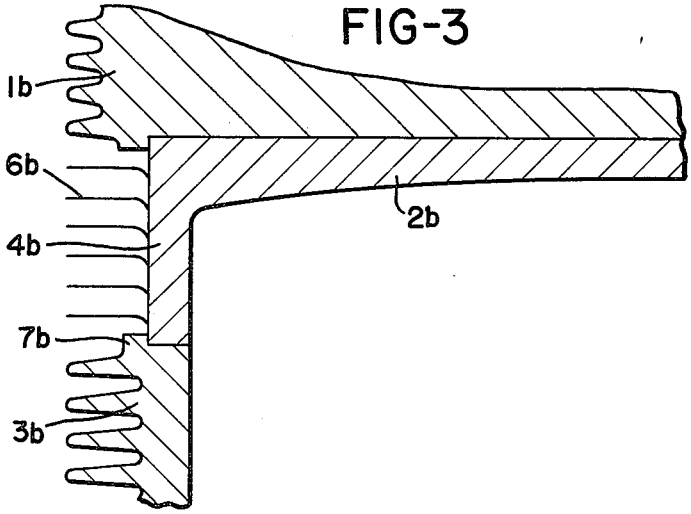
FIGS. 3–5 show still further embodiments of the present invention.

In the embodiment of FIG. 3, the metal plate 2*b* likewise is made in one piece or unitary with the annular insert 4*b*. However, in this embodiment, the metal plate 2*b*, with its annular insert 4*b*, is installed in the cylinder head bottom in such a way that the cylinder head bottom can expand freely radially outwardly upon heating. So that nevertheless a force, depending upon the heating of the structural parts, is effective on the metal plate 2*b* in such a manner that it is pressed more strongly against the cylinder head bottom, the end face of the cylinder barrel or pipe 3*b* is provided with a continuous annular flange or collar 7*b*, against the inner side of which the outer side of the annular extension 4*b* engages. The annular insert 4*b* in this embodiment is likewise provided with cooling ribs 6*b*. In essence, the light metal cylinder head 1*b* has a bottom directed toward the associated combustion chamber. The flange or shoulder which is axially extending from the cylinder head toward the combustion chamber includes a first surface facing radially inward and a second surface facing axially. The first surface which faces radially inward engages the annular insert 4*b*. The continuous flange or collar 7*b* on the cylinder barrel 3*b* forms an axially extending annular shoulder which extends toward the cylinder head 1*b*. The shoulder 7*b* has a first surface facing radially inward and a second surface facing axially with the shoulder being outboard of an axially facing, upward surface which engages the bottom of the insert 7*b*. The width of the insert 4*b*, or rather of the annular portion of the insert, is no more than about three times the thickness of the shoulders 7*b* or the shoulder on the cylinder head 1*b*. During engine operation, thermal expansion urges the entire insert, consisting of portions 4*b* and 2*b*, and the cylinder head 1*b* snugly against one another.

Upon heating of the metal plate 2*b*, this plate is essentially precluded from a radial expansion by the annular insert 4*b* since this extension, on the one hand, is provided with cooling ribs 6*b* and consequently is considerably cooler than the metal plate 2*b*, and, on the other hand, is precluded from a radial expansion by the collar 7*b* of the cylinder pipe 3*b*. Via the here likewise concavely curved side of the metal plate facing the combustion chamber, the pressing-on or engagement against the cylinder head bottom upon heating is additionally increased.

Figure 4:
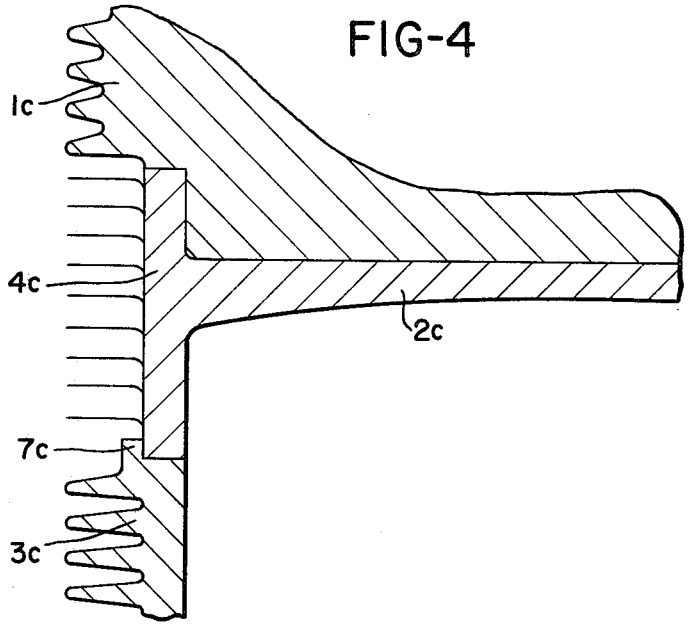

FIG. 4 shows a combination of the two arrangements of the annular extensions 4*a* and 4*b* of FIGS. 2 and 3; i.e., the cylinder head 1*c* is again surrounded externally by the annular extension 4*c*, whereas the cylinder pipe 3*c* has a continuous flange or collar 7*c*, against the inner side of which the outer side of the annular insert 4*c* engages. By this arrangement, the force reacting considerably to the heat expansion of the cylinder head and the metal plate is strengthened, so that the metal plate 2*c* is pressed with a very high pressure against the cylinder head bottom.

Figure 5:
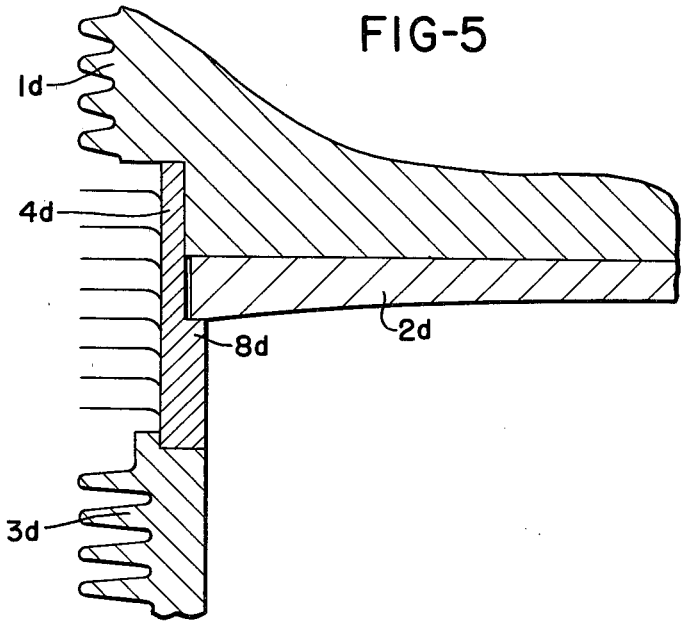

FIG. 5 illustrates how the metal plate 2*d* can be fastened on the annular insert 4*d* when they are embodied as two separate parts, with the annular insert 4*b* being provided with a shoulder 8*d* for receiving the metal plate 2*d*. In such a case, it is possible to produce the annular insert 4*d* of a different material than is used for the metal plate 2*d*, especially to undertake an optimization with regard to heat dissipation. Examples of metals which can be used include gray cast iron, cast steel, and spheroidal graphite cast iron. The important thing to remember is that the metal plate and the insert must be of different material than the cylinder head.

Naturally also the examples of the annular insert with the metal plate illustrated in FIGS. 1 through 4 can be embodied as two separate pieces.

The present invention is, of course, in no way restricted to the specific disclosure of the specification and drawings, but also encompasses any modifications within the scope of the appended claims.

What I claim is:

1. A light metal cylinder head arrangement in combination with combustion chambers of internal combustion engines, comprising in combination:

a light metal cylinder head having a bottom directed toward an associated combustion chamber, the cylinder head having an axially extending, annular shoulder extending toward the combustion chamber, which shoulder has a first surface facing radially inward and a second surface facing axially;

a cylinder barrel, spaced from the cylinder head, and having an axially extending annular shoulder extending toward the cylinder head, the shoulder of said cylinder barrel having a first surface facing radially inward and a second surface facing axially, the shoulder of said cylinder barrel being outboard of an axially facing surface;

an insert of ferris metal disposed between the cylinder head and cylinder barrel; the insert including a plate portion and an annular portion integral therewith; the plate portion having a flat surface abutting the bottom of the cylinder head and a concave surface facing the combustion chamber; the annular portion extending from the plate portion toward the cylinder barrel with the entire plate portion being inboard of the annular portion; the annular portion having a thickness no more than about three times the thickness of the shoulders as measured across the second surfaces thereof; the insert being in abutment with the first surfaces of the shoulders and the axially facing surface of the cylinder barrel; whereby during engine operation thermal expansion urges the insert and cylinder head snugly against one another.

* * * * *